United States Patent [19]

Bach

[11] Patent Number: 5,047,280

[45] Date of Patent: Sep. 10, 1991

[54] HIGH DENSITY CORRUGATED WAFER BOARD PANEL PRODUCT

[75] Inventor: Lars Bach, Edmonton, Canada

[73] Assignee: Alberta Research Council, Edmonton, Canada

[21] Appl. No.: 293,073

[22] Filed: Jan. 3, 1989

[51] Int. Cl.[5] ..... B32B 3/28; E04C 2/32

[52] U.S. Cl. ..... 428/182; 428/106; 428/107; 428/174; 428/219; 428/220; 428/326; 428/537.1; 428/541; 52/795; 52/814

[58] Field of Search ..... 52/450, 795, 814; 428/167, 172, 174, 175, 179, 182, 340, 541, 537.1, 50, 528, 529, 326, 106, 107, 219, 220

[56] References Cited

U.S. PATENT DOCUMENTS

| | | | |
|---|---|---|---|
| 4,232,067 | 11/1980 | Coleman | 428/167 |
| 4,284,676 | 8/1981 | Etzold | 428/167 |
| 4,372,899 | 2/1983 | Wiemann et al. | 264/120 |
| 4,548,851 | 10/1985 | Greer | 428/332 |
| 4,610,900 | 9/1986 | Nishibori | 428/167 |
| 4,616,991 | 10/1986 | Bach et al. | 425/406 |
| 4,675,138 | 6/1987 | Bach et al. | 264/294 |

*Primary Examiner*—Ellis P. Robinson
*Assistant Examiner*—Donald J. Loney
*Attorney, Agent, or Firm*—Dressler, Goldsmith, Shore, Sutker & Milnamow, Ltd.

[57] ABSTRACT

A 'high density' corrugated wafer board panel is provided. The wafer board panel has a substantially uniform density ranging from between about 700 kg/m$^3$ to 900 kg/m$^3$. As a result of increasing the density of the panel without changing the panel weight per projected unit area, a panel having improved overall flexure performance properties is provided.

1 Claim, 1 Drawing Sheet

HIGH DENSITY CORRUGATED WAFER BOARD PANEL PRODUCT

FIELD OF THE INVENTION

The present invention relates to a 'high density' wafer board panel having a corrugated, or wave-like, configuration.

BACKGROUND OF THE INVENTION

Typically, a wafer board panel comprises layers of wood flakes or wafers formed into a composite structure using a resinous binder. The preparation of wafer board panels is complex, but broadly consists of two principal stages. The first stage comprises the preparation of the wafers and admixing thereof with the binder to form a loose layer or mat; the second stage involves subsequent compression and heating of the mat to cure the resin and form the consolidated panel.

At present, wafer board is usually manufactured in the form of planar or flat sheets. Wafer board is a recognized structural panel, finding wide application in the construction industry, particularly as a plywood substitute in residential construction.

Improvement in performance characteristics of flat wafer board panels has been attained by optimization of such parameters as wafer orientation, wafer geometry, resin selection and content, and the like.

After exhaustive optimization studies of planar wafer board it was postulated that its flexural strength characteristics could be improved if a corrugated configuration was imparted thereto. The fundamental concept of corrugating materials to thereby improve the structural properties is not a novel one. Indeed, corrugated wafer board per se has previously been manufactured in the industry. However, the wafer board panels prepared by these prior art techniques do not have the capability of economical industrial manufacture or the desired structural strength properties because they do not have a substantially uniform density.

In a recent advance, as disclosed in my U.S. Pat. No. 4,616,991, an apparatus for manufacturing a corrugated wafer board panel having a substantially uniform density was developed. The breakthrough disclosed by the patent referred to supra, resided in the apparatus being adapted to avoid having to 'stretch' a planar mat into a corrugated conformation. Stretching, which had always been present in the prior art methods, would result in a final product exhibiting an uneven distribution of wood flakes and hence non-uniform density.

This prior apparatus involved a pair of opposed, spaced-apart, upper and lower platens. Each platen was formed of adjacent lengths of chain-like links. When the lengths were pushed inwardly from the side, they would shift from a planar to a sawtooth-like form. In doing so, the length of the non-undulating space between the platens in the second stage would be generally the same as the length of the planar space between the platens in the first stage. The process involved in using the apparatus was initiated by distributing a mat of loose binder-coated wood wafers between said platens. A pre-compression step was conducted by biasing the platens together, the biasing force being applied in a vertical direction, to substantially fix the wafers, thereby limiting their further movement. The platens were then biased from the side to convert them from their planar configuration to the corrugated configuration. Heat and further pressure were applied to cure the binder and produce the panel of uniform density.

The density of raw wood varies considerably. However, by the completion of the compaction and curing processes, the density of the produced wafer board will have been increased, typically by a value of about fifty percent more than that of raw wood.

It is recognized that the industry selects the density of wafer board panels so as to provide the optimum structural strength commensurate with the lowest price in terms of raw materials and manufacturing costs. So, for a typical planar (or flat) wafer board panel, its selected density would be of the order of about 640 kg/m$^3$.

It is generally known that if one were to increase the density of a planar wafer board panel, specific material properties (namely E—modulus of elasticity, and MOR-modulus of rupture) would improve. However, such improvements would be at the expense of the 'overall flexure strength' properties thereof. By overall flexure strength, bending moment capacity, load capacity, or bending strength, is meant the multiple of 'S' (section modulus) and 'MOR' (modulus of rupture). Additionally, it is accepted that if the density of the planar wafer board panel is increased, its 'bending stiffness' will also decrease. Bending stiffness is defined as the multiple of E and I (where E is the modulus of elasticity and I is the moment of inertia).

By 'high density', 'normal density', and 'low density' in the present context is meant wafer board having substantially uniform densities in the ranges of 700–900 kg/m$^3$; 600–700 kg/m$^3$ and 400–600 kg/m$^3$ respectively.

In summary, therefore, the commonly held belief in the art was that to increase the density of a wafer board panel above the normal would result in a panel having reduced values in certain important structural properties. Such an increase in density was therefore to be avoided.

SUMMARY OF THE INVENTION

In accordance with the present invention, I have determined that for a corrugated wafer board panel, it is possible to provide an improvement in its overall flexure performance properties by increasing the density thereof.

This observation is based on the discovery that the modulus of rupture (MOR), for a corrugated panel, increases proportionately more than the modulus of elasticity (E) thereof and that the section properties for corrugated wafer board change less as its density is increased, relative to flat wafer board. Stated otherwise, I have found that if the density of flat and corrugated wafer board are increased without changing the unit panel mass per projected surface area, the results are approximately as follows.

| | Specific Material Properties | | Section Properties | | Overall Bending Properties | |
|---|---|---|---|---|---|---|
| | E | MOR | I | S | E.I | S.MOR |
| Flat Waferboard | up | up more than "E" | down | down | down | equal to down |
| Waveboard | up | up more than "E" | down less than flat- | down less than flat- | no major change | up |

-continued

| Specific Material Properties | | Section Properties | | Overall Bending Properties | |
|---|---|---|---|---|---|
| E | MOR | I | S | E.I | S.MOR |
| | | board | board | | |

And, as stated earlier:
bending stiffness equals: E.I
bending strength equals: S.MOR.

By bending stiffness and strength is here meant stiffness and strength performance in one direction namely the direction where the wave top parallels the span.

I have discovered that the bending strength (S.MOR) of corrugated wafer board increases as its density is increased, and the bending stiffness remains essentially unchanged provided the panel weight per unit area is kept constant.

Advantageously, by providing a board having a higher density it is possible to obtain better wood utilization than in lower density corrugated waveboard. This finding is the opposite to the case for flat waferboard.

Broadly stated, the invention is a corrugated wafer board formed of binder-coated wafers which have been subjected to heating and compression, which comprises: having a substantially uniform density resulting from the even distribution of wafers therein, said density ranging from between about 700 kg/m$^3$ to 900 kg/m$^3$.

DESCRIPTION OF THE PREFERRED EMBODIMENT

Figure 1:
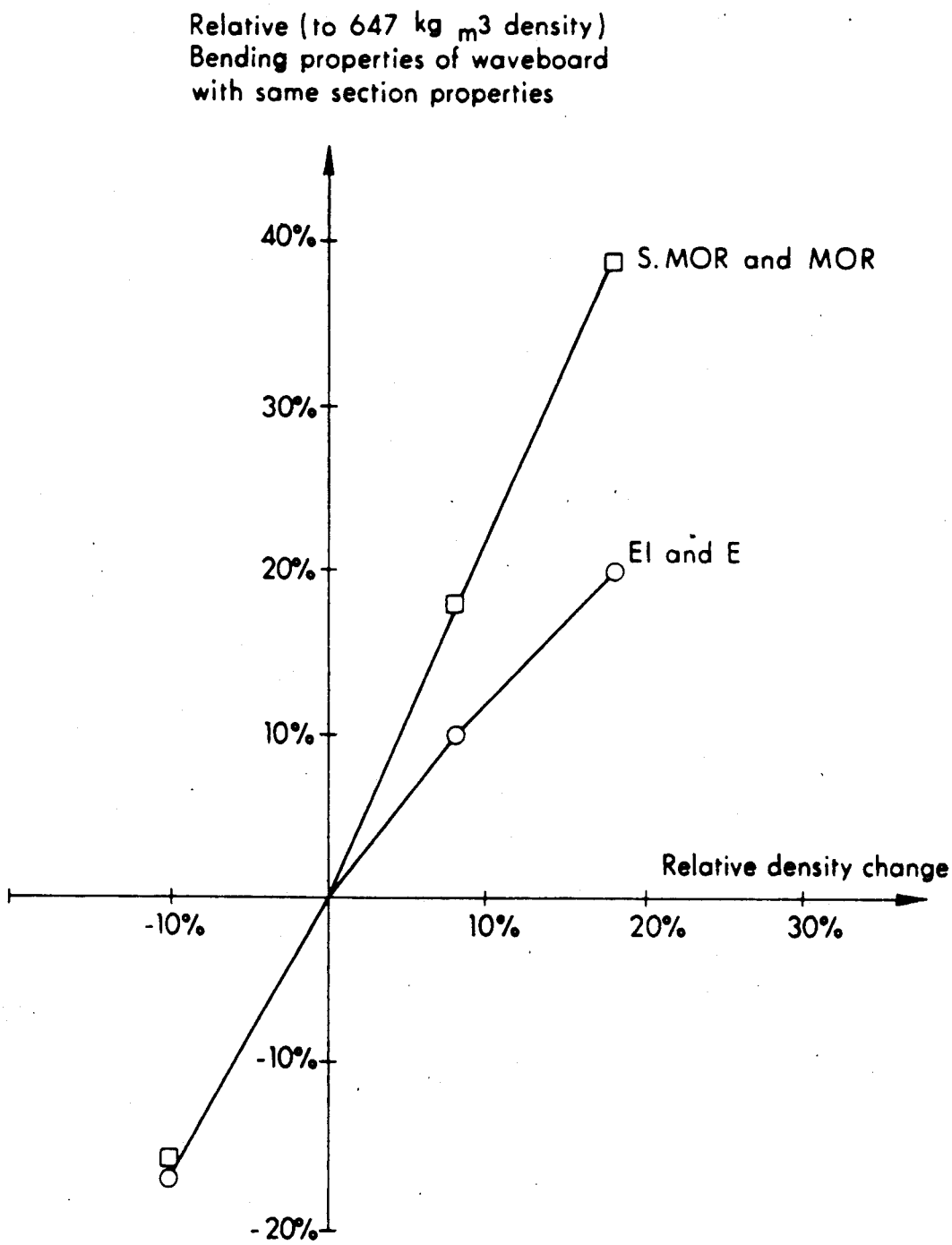
FIG. 1 is a plot showing the relative bending strength (S.MOR) and relative bending stiffness (E.I) improvement in corrugated wafer board (having the same section properties) versus density change.

The corrugated wafer board panels having a wave-like configuration were prepared using the process and platen system described in U.S. Pat. No. 4,616,991. As stated earlier, the platen system involved a pair of opposed, spaced-apart upper and lower platens. Each platen was formed of adjacent lengths of chain-like links. Upon application of a lateral force thereto, the link assembly would move from a planar to a corrugated form. The final outside dimensions of the prepared panels were 24"×36", the skin thickness was approximately 11.3 mm (7/16"), and the panel depth wave peak to bottom was 63.5 mm (2½"). Additionally, it can be appreciated that the final panel size can be scaled up to 1220×4880 mm (4'×16'). Boards having panel densities from 647 kg/m$^3$ up to 768 kg/m$^3$ were prepared.

The process for preparing the 'high density' corrugated wafer board comprised the following steps:

The furnish could be prepared using various wood species. Aspen logs approximately 8' in length and 6"–14" in diameter were used. The logs were cleaned, debarked, waferized and screened. The strand or wafer length averaged 76 mm (3") and the thickness was about 0.76 mm (0.03"), however other strand or wafer geometrics can be used.

The moisture content of the furnish was reduced from the green state to about 5% using commercial dryers. The wafer were screened following drying.

At 5% moisture content, the furnish was blended with 3% by weight of powdered phenol formaldehyde resin and 1% by weight wax in a laboratory drum blender. Wax was utilized to improve the moisture resistance of the panel. Resin was utilized as a binder for the wafers.

The wafers and wax/resin in admixture were arranged loosely by hand between two flexible stainless steel screens (cauls) to form the mat. The quantity of wafers and resin used was sufficient to produce a board having the requisite density. The cauls had previously been dusted with talcum powder to prevent bonding of the wafers thereto. Using the cauls, the mat was transferred to the press.

In the press, the mat was subjected simultaneously to high temperature, which set the binder, and to high pressure which compressed the mat to specified thickness. More particularly, the corrugated platen temperature was maintained at 205° C. The platen was heated by electrically heated rods extending within the press platens.

The open or fully extended surface area of the platens was 920×920 mm.

To obtain pre-compression and corrugation the press was operated in a manual control mode. Once the mat was in place on the platens, a vertical pre-compression force of less than 3.4×10$^6$ Newton's was applied. Application of this force brought the top and bottom platens towards one another. At this displacement, the platens were, following pre-compression, actuated into the corrugated configuration by application of a horizontal side force of less than 0.52×10$^6$ Newtons thereto.

A final compression was applied by bringing the press platens closer together, until the latter reached their stops. The panel was retained between the press platens for four minutes to allow the resin to set.

Prior to removal of the finished wafer board panel from the press, the pressure was released slowly to avoid steam release damage.

The panels were then cooled.

It is to be noted that if a section of the panel prepared in accordance with the procedure outlined hereabove was taken at any point along its length and its density was measured, the density value was substantially uniform.

EXPERIMENTAL

EXAMPLE I

Table I and FIG. 1 exemplify the improvement in bending strength (S.MOR) and bending stiffness (E.I) as the density of corrugated wafer board panels are increased. The panels were prepared using 3" (76 mm) long aspen flakes and 3% powdered phenol formaldehyde resin.

The wavelengths of all the panels were 189 mm, the panel depths were 64 mm and the skin thicknesses were 11.3 mm. The section properties for all four panel types mentioned in this example are therefore the same. The wafer lengths were 104 mm.

TABLE I

| UNITS | Panel Density kg/m$^3$ | Unit Bending Strength S.MOR N.mm/mm | Unit Bending Stiffness E.I N.mm$^2$/mm | Relative MOR | Relative E |
|---|---|---|---|---|---|
| WAVEBOARD | | | | | |
| | 581 | 3350 | 17,200,000 | 84% | 84% |

TABLE I-continued

| UNITS | Panel Density kg/m³ | Unit Bending Strength S.MOR N.mm/mm | Unit Bending Stiffness E.I N.mm²/mm | Relative MOR | Relative E |
|---|---|---|---|---|---|
| | (90%) | (84%) | (84%) | | |
| | 647 | 4000 | 20,400,000 | 100% | 100% |
| | (100%) | (100%) | (100%) | | |
| | 700 | 4720 | 22,500,000 | 118% | 110% |
| | (108%) | (118%) | (110%) | | |
| | 768 | 5560 | 24,400,000 | 139% | 120% |
| | (119%) | (139%) | (120%) | | |

EXAMPLE II

Table II given herebelow, demonstrates that for two flat wafer board panels, one having a 'high density' and one having a 'normal density', both the overall flexure strength value, (S.MOR) and the bending stiffness (E.I) decreased in the 'high density' sample. The table further illustrates the increase in overall flexure strength (S.MOR) when the density is increased for corrugated wafer board without increasing the amount of wood and binder used.

TABLE II

| | Waveboard* | | Flat Waferboard | |
|---|---|---|---|---|
| | Normal Density Value | High Density Value | Normal Density Value | High Density Value |
| Unit Panel Weight (kg/m²) | 8.3 | 8.2 | 6.8 | 6.8 |
| Panel Density (kg/m³) | 667 | 846 | 651 | 846 |
| Thickness (mm) | 10.2 | 8.0 | 10.5 | 8.0 |
| Unit Bending Strength (N.mm/mm) S.MOR | 3,247 | 3,609 | 398 | 349 |
| Unit Bending Stiffness (N.mm²/mm) | 16,470,000 | 16,300,000 | 462,000 | 279,600 |

TABLE II-continued

| | Waveboard* | | Flat Waferboard | |
|---|---|---|---|---|
| | Normal Density Value | High Density Value | Normal Density Value | High Density Value |
| (N.mm²/mm) | | | | |

*The wave peak to wave bottom depth was approximately 64 mm and wavelength was 188 mm. All the panels were manufactured using 3" (76 mm) long aspen flakes and 2.5% powdered phenol formaldehyde resin.

EXAMPLE III

Table III below provides a comparison of the properties of waveboard having a control density value and a high density value wherein the panels were manufactured using 4" aspen flakes and 3% isocyanate (MDI) resin. The peak to peak depth was approximately 64 mm and the wavelength was 188 mm. The wafer lengths were 104 mm.

TABLE III

| | Waveboard | |
|---|---|---|
| | Control Density Value | High Density Value |
| Unit Panel Weight (kg/m²) | 9.4 | 9.4 |
| Panel Density (kg/m³) | 691 | 835 |
| Thickness (mm) | 11.2 | 9.2 |
| Unit Bending Strength (Nmm/mm) S.MOR | 4762 | 5220 |
| Unit Bending Stiffness (Nmm²/mm) E.I | 22,503,000 | 22,154,000 |

The embodiments of the invention in which an exclusive property or privilege is claimed are defined as follows:

1. A corrugated wafer board formed of binder-coated wafers which have been subjected to heating and compression which is characterized by having a density ranging from between about 700 kg/m³ to 900 kg/m³, said density throughout said board being substantially uniform, and wherein the panel mass per unit area is substantially equal to a corrugated wafer board of normal density, whereby the bending strength is increased and the bending stiffness remains substantially equal to a wafer board of normal density and the amplitude of said board ranges from about 3 mm to 100 mm (0.125" to 4").

* * * * *